United States Patent [19]

Studer

[11] Patent Number: 4,627,516

[45] Date of Patent: Dec. 9, 1986

[54] SELF-LEVELING LADDER CONSTRUCTION

[75] Inventor: Lewis O. Studer, Summerfield, Ohio

[73] Assignee: Harry V. Moore, Walkerville, Mich.; a part interest

[21] Appl. No.: 815,557

[22] Filed: Jan. 2, 1986

[51] Int. Cl.[4] ..... E06C 7/44

[52] U.S. Cl. ..... 182/202; 248/188.3

[58] Field of Search ..... 182/200–205; 248/188.3

[56] References Cited

U.S. PATENT DOCUMENTS

| | | | |
|---|---|---|---|
| 2,894,670 | 7/1959 | Anderson et al. | 182/202 |
| 3,027,969 | 4/1962 | Erickson | 182/202 |
| 3,233,702 | 2/1966 | Feltrop | 182/202 |
| 4,128,139 | 12/1978 | Cook, Sr. | 182/202 |

FOREIGN PATENT DOCUMENTS

| | | | |
|---|---|---|---|
| 342693 | 8/1936 | Italy | 182/202 |

*Primary Examiner*—Reinaldo P. Machado
*Attorney, Agent, or Firm*—Sand & Hudak Co.

[57] ABSTRACT

An automatic self-leveling ladder having a leveling leg axially slidably mounted within the bottom of each member of a pair of spaced vertical rung supporting members for automatically compensating for unevenness in the support surface. A rack is fixed to each of the legs and is engaged by a gear located within each of the legs that is mounted on an end of a stub shaft. A locking device is fixed on each of the rung supporting members and engages the gears upon application of the weight of the ladder on the legs to lock the legs in a selected leveling position. The stub shafts extend inwardly from the rung supporting members and are located within a complementary sized tubular telescoping member which serves as the bottom rung of the ladder. One of the stub shafts is fixed to the tubular member so the member rotates with the shaft. The shafts are joined by a spring steel strip to rotate the shaft in unison and to compensate for torsional forces exerted on the two stub shafts when in locked positions. A coil spring biases each of the stub shaft gears out of locked position with the locking devices. Upon placing the legs on a supporting surface, the weight of the ladder is sufficient to overcome the spring biasing force whereupon the legs automatically level themselves and the locking devices engage with the gears to lock the legs in a level position. Upon removal of the ladder weight from the legs the springs move the gears out of engagement with the locking devices.

13 Claims, 9 Drawing Figures

SELF-LEVELING LADDER CONSTRUCTION

TECHNICAL FIELD

The invention relates to ladders and in particular to ladders having self-leveling mechanisms formed as a part thereof to provide an automatic self-leveling ladder which adjusts itself and locks under the weight of the ladder to compensate for uneven supporting surface.

BACKGROUND ART

The problem arising from supporting ladders upon nonlevel support surfaces wherein the supports for the legs are not in the same horizontal plane are well known and numerous types of devices have been proposed to compensate for this condition. Such devices include adjustable extensions affixed to each ladder leg, arcuate adjustable supports and self-leveling extensions wherein frictional locking engagement of the extension with the ladder is produced by the weight of the operator upon the ladder. Such devices have not provided the answer to the problem since manually adjustable leg extensions and arcuate supports require time consuming adjustment at each location of the ladder and existing self-locking leveling devices do not lock with the desired positive action so as to prevent malfunctions and consequently do not provide the insurance of safety necessary when using a ladder. Actual experience also has shown that the attention of painters, workmen, etc. may be directed to other matters causing them to forget to lock and unlock a manually operated leveling device causing a safety hazard.

Many of these problems have been overcome by a self-leveling ladder attachment shown in U.S. Pat. No. 2,894,670 of which I am a coinventor thereof. However, it has been found that such attachment devices are relatively bulky and difficult for the average home owner to install with sufficient confidence that the leveling attachment will work in the manner intended and with the required safety. Furthermore, the self-leveling attachment of my earlier invention required a considerable number of specially designed component parts which increased the weight and cost of the attachment making it less attractive for purchase by the average home user desiring a self-leveling ladder. It is believed that the home user desires such a self-leveling ladder if it does not increase the weight of the ladder appreciably and if the leveling device is formed as a part of the ladder eliminating any attachment or addition to of the ladder after purchase. Furthermore, the reduction in the number of parts required to achieve the automatic self-leveling effect reduces both the cost and weight of the ladder which is very attractive to the home user.

Examples of known prior art self-leveling devices are shown in U.S. Pat. Nos. 2,552,941; 2,598,875; 3,027,969; 3,037,581; 3,173,512; 3,215,383; 3,233,702; 4,095,671; 4,128,139 and 4,497,390. Although the devices of some of these patents do provide a ladder having a self-leveling mechanism incorporated as a part of the ladder in contrast to a separate leveling attachment therefor, these devices require an excessive number of parts thereby increasing the complexity of the ladder, the cost and the possibility of maintenance problems. Furthermore, many of these self-leveling devices and ladders are not automatic and require manual manipulation of a locking device to secure the ladder in the adjusted level position.

Therefore, the need has existed for an improved automatic self-leveling ladder in which the self-leveling mechanism is formed as a part of the ladder and requires a minimum number of components thereby providing an inexpensive, lightweight yet highly efficient and safe ladder construction.

DISCLOSURE OF THE INVENTION

Objectives of the invention include providing an improved automatic self-leveling ladder which automatically adapts immediately to leg support services of different heights and locks with a positive action, and in which the locking of the self-leveling legs is provided by gears simultaneously engaging racks secured to the adjusting legs.

A further objective of the invention is to provide such a self-leveling ladder extremely lightweight, rugged, and containing a reduced number of components than heretofore used with prior self-leveling ladders to reduce maintenance problems without sacrificing efficiency and safety thereof. Still another objective is to provide such a ladder which is self-locking and releasing, which will adapt itself to the supporting surface, merely by placing the ladder on the surface and without requiring the operator from placing weight on one of the rungs thereof, and in which the ladder is released from a locked position merely by picking the ladder up from its ground engaging position, and in which gears and associated locking devices are mounted in each of the ladder legs and associated vertical rung supporting members and are interconnected by a pair of stub shafts and a leaf spring which supports a single tubular member telescopically mounted on the stub shafts to form the lower rung of the ladder; and in which the tubular member is attached to one of the stub shafts for rotation with the shaft to reduce the number of components heretofore required for supporting such a tubular member as in prior ladder constructions.

These objectives and advantages are obtained by the improved self-leveling ladder construction of the invention, the general nature of which may be stated as including a pair of spaced vertical rung supporting memberse; a leg axially slidably mounted within each of the rung supporting members at the bottom of each of said supporting members; a rack affixed to each of said legs; a rotatably mounted gear engaging each of said racks; drive means internconnecting the gears for simultaneous rotation in the same direction, said gears engaging the racks on opposite sides of the gears whereby movement of one of the legs in one of the legs in one direction produces an opposite movement of the other leg; gear lock means mounted on each of the rung supporting members adjacent each of the gear for engaging the gears to releaseably lock the gears in a selected position; and said drive means including a stub shaft attached to each of the gears, a tubular telescoping member extending generally between the rung supporting members adapted to function as a lower rung and connected to one of the stub shafts for rotation with said shaft, and a leaf spring extending between and in engagement with the stub shafts within said tubular telescoping member, said stub shafts having outer diameters generally equal to the inner diameter of the telescoping member whereby said stub shafts support said telescoping member.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
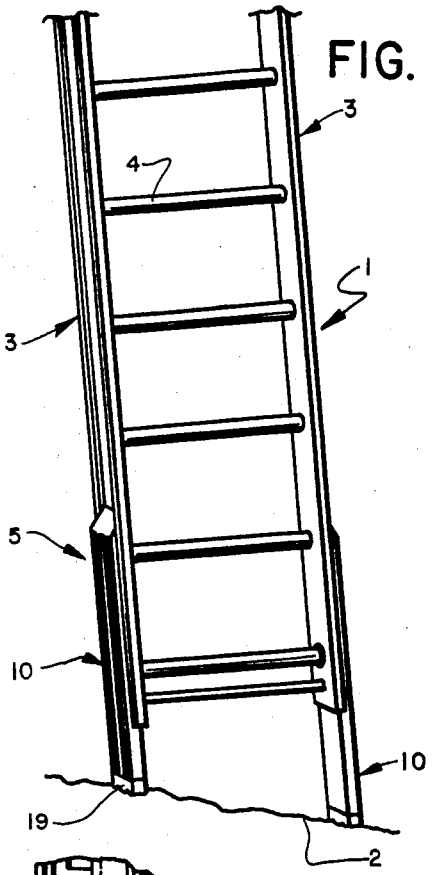
FIG. 1 is a diagrammatic perspective view of the improved self-leveling ladder supported on an uneven surface.

The improved self-leveling ladder construction is indicated generally at 1, and is shown in FIG. 1 resting on an uneven supporting surface 2. Ladder 1 includes a pair of spaced vertically extending rung supporting members 3 with a plurality of horizontal rungs 4 extending therebetween as in a usual ladder construction. Rungs 4 preferably are tubular shaped members or could be flat step-like supporting members if desired without affecting the concept of the invention.

The improved levelizing device which is formed as part of the ladder and incorporated in the lower end of each vertical rung support member 3 is indicated generally at 5. Each rung supporting member 3 has an outwardly opening U-shaped channel configuration formed by a central web wall 7 (FIGS. 3 and 4) and a pair of outturned ends flanges 8 which have inwardly projecting ribs 9 formed on the outer ends thereof. Rung support members 3 preferably are formed of a rigid lightweight metal such as aluminum.

Each self-leveling device 5 includes leg indicated generally at 10, which is axially slidably mounted on each of the rung supporting members 3 and moved between and locked in a leveling position by drive means indicated generally at 14 and described more fully below. Legs 10 (FIGS. 4, 5 and 6) preferably are formed of aluminum extrusions or other lightweight metal and are rectangular in cross section having one of the sides partially opened which is located closely adjacent to the closed side or web wall 7 of each rung supporting member 3. Each leg 10 includes an outer web wall 11 and a pair of spaced parallel side walls 12 which terminate in inwardly extending wall sections 13.

Figure 2:
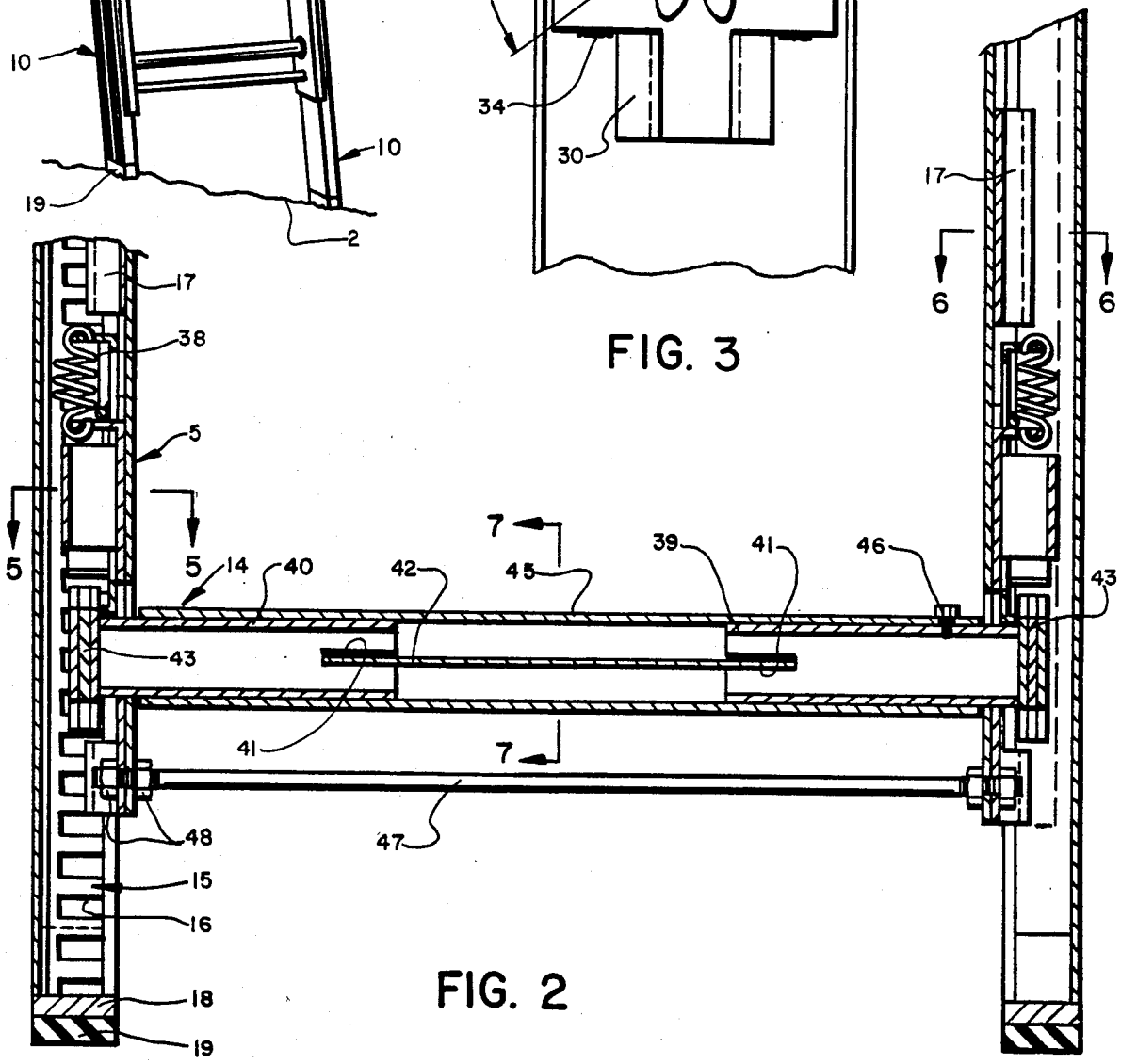
FIG. 2 is an enlarged fragmentary sectional view of the self-leveling mechanism incorporated into the lower end of the ladder of FIG. 1.
Figure 5:
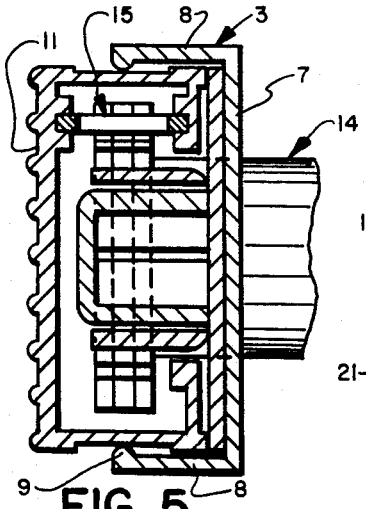
FIG. 5 is an enlarged fragmentary sectional view taken on line 5—5, FIG. 2.
Figure 6:
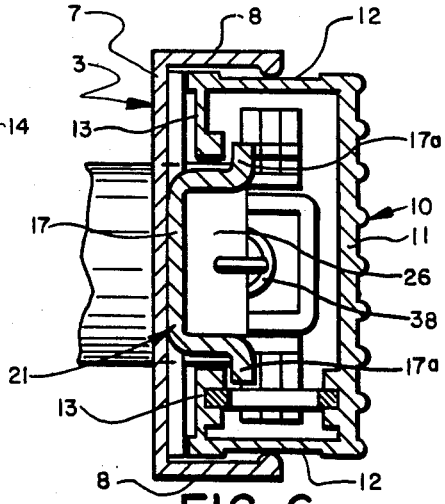
FIG. 6 is an enlarged fragmentary sectional view taken on line 6—6, FIG. 2.
Figure 7:
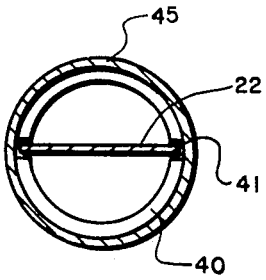
FIG. 7 is an enlarged sectional view taken on line 7—7, FIG. 2.

When axially slidably mounted within the open side of U-shaped rung supporting members 3 as shown in FIGS. 5 and 6, guide ribs 9 of members 3 slidably engage side walls 12 of legs 10. As can be seen in FIGS. 2, 5 and 6, legs 9 are trapped within members 3 and are prevented from outward pivotal like movement by a generally U-shaped metal strip 17 have outturned end 17*a*. A rack 15 is mounted between flange wall 11 and inturned wall section 13 on opposite sides of legs 10 as shown in FIGS. 5 and 6. Rack 15 is formed of a stamped flat stock with a series of evenly spaced holes 16 to receive gear teeth therein. Racks 15 preferably extends a desired distance along the length of each leg 10.

As can be seen by the left hand rack 15 in FIG. 2, it is inclined slightly to the right to compensate for any outward skewing of the lower ends of the ladders. This slight skewing which is exaggerated in FIG. 2 will not afford any obstacle to the running of the locking gears as described below which are captured in the rack openings. Also, the left hand side of holes 16 are not at right angles to the bottom of the holes which prevents binding of the locking gears therein when racks 15 are used on ladders having skewed bottom levelizing legs 10. A base plate 18 preferably is mounted on the lower end of each leg 10, substantially the same size as the leg, whereby safety feet 19 may be affixed to the legs over base plate 18.

A locking device indicated generally at 20 (FIGS. 3 and 4) is mounted on the inside surface of web wall 7 of each support member 3. Locking device 20 includes a disengagement plunger indicated generally at 21, having a U-shaped configuration formed by a web wall 22 and a pair of side walls 23. An elongated slot 24 is formed in web wall 22 and extends generally longitudinally throughout the length of wall 22. A pin 25 extends between side walls 23 and is spaced below an outturned top flange 26 for stopping the descent of a locking element as described below. The lower ends of side walls 23 terminate in shoulders 27 from which depends a shaft abutting surface 28.

Figure 3:
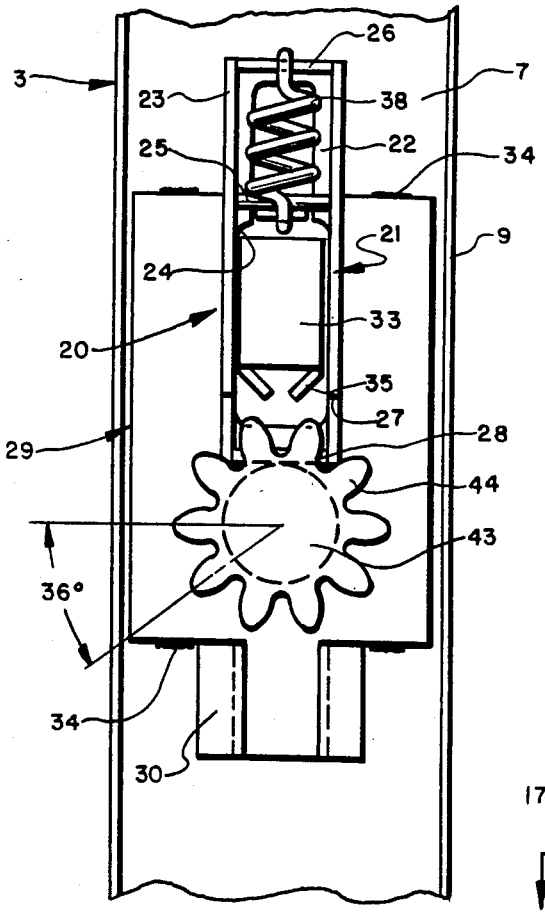
FIG. 3 is an enlarged fragmentary elevational view of the gear and gear locking device shown in unlocked position.
Figure 4:
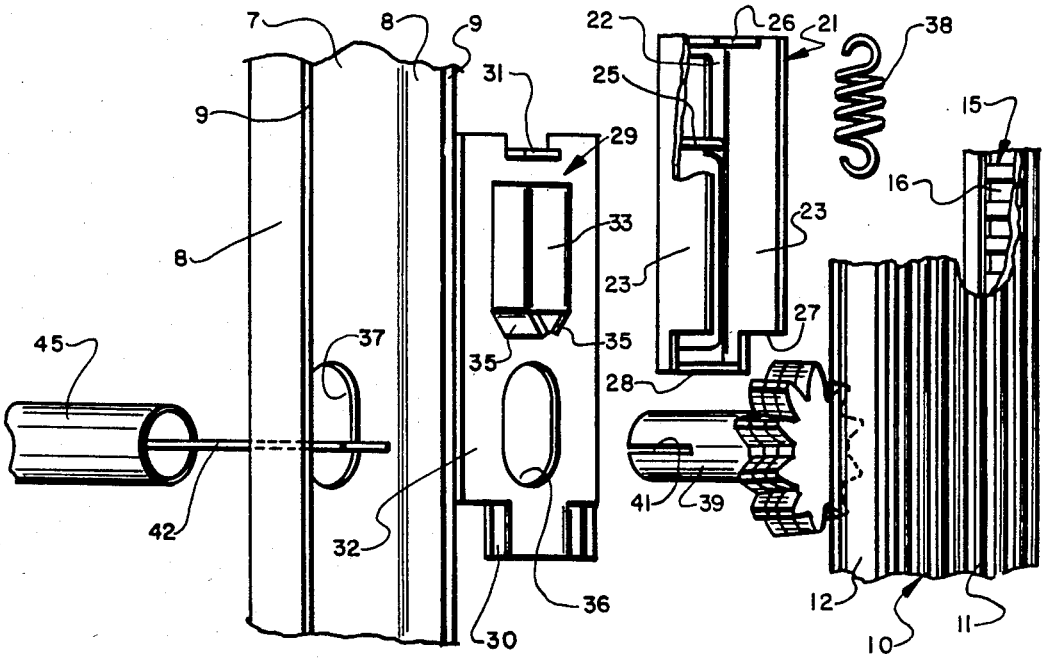
FIG. 4 is an exploded fragmentary perspective view of the components associated with each leg of the self-leveling mechanism and associated rung supporting member.

A gear lock indicated generally at 29, is fixed by welds 34 or other attachment means to the inside surface of each web wall 7 as shown particularly in FIGS. 3 and 4. Gear lock 29 includes a generally flat metal plate 32 having a pair of inturned tabs 30 at the bottom end thereof and a top outwardly projecting tab 31. A gear locking element 33 is attached to plate 32 and has a rectangular outwardly projecting configuration with pair of gear engaging teeth 35 which converge toward each other and terminate in a spaced relationship to each other. Plate 32 is formed with an elongated opening 36 which aligns with an elongated opening 37 formed in web wall 7 of supporting member 3. A tension coil spring 38 is connected at its upper end to tab 26 of plunger 21 and at its lower end to tab 31 of lock plate 32. Spring 38 biases plunger 21 downwardly toward drive means 14. The downward decent of plunger 21 is limited by the engagement of pin 25 with the top of locking element 33.

Drive means 14 includes a pair of stub shafts 39 and 40 preferably formed of hollow tubes which have slotted outer ends 41 for receiving the ends of a strip of spring steel 42. The outer ends of each stub shaft is attached to a gear 43 having a plurality of sprocket like teeth 44 (FIG. 3). The stub shafts are telescopically mounted within an outer tubular member 45 which extends generally throughout the horizontal spacing between rung supporting members 3 (FIG. 2). The inner diameter of tubular member 45 is generally equal to the outer diameter of the stub shafts and function as a lower rung for the ladder with the weight of an operator stepping on tubular member 45 being absorbed by the stub shafts. Preferably, the stub shafts each extend into tubular member 45 a distance equal to approximately one-third of the total length of member 45 to provide sufficient rigidity and support for member 45. Stub shaft 39 is attached by a bolt 46 to tubular member 45 so that member 45 rotates with shaft 39. Spring strip 42 provides a driving connection between the stub shaft and compensats for any torsional forces exerted on the stub shafts when legs 10 are in locked position.

A bottom tie rod 47 is attached to web wall 7 of each rung support member 3 by two pairs of nuts 48 to prevent the outward movement of the lower ends of members 3. Preferably, each gear 43 has ten gear teeth 44 formed thereabout providing an angular separation of 36 degrees between the outer tips of each tooth as shown in FIG. 3. This number of gear teeth can vary without affecting the concept of the invention.

The operation of the improved self-leveling ladder 1 is as follows. The ladder is lifted and placed in a desired location and should the surface supporting the ladder be such that one of the feet 19 engages the surface on which the ladder is to be supported before the other foot 19 due to an uneven support surface, the leg 10 engaging the support surface first will move upwardly due to the weight of the ladder and the other leg 10 will be driven downwardly due to the rack and gear coupling interconnecting the gears since the gears contact the racks on opposite sides of the gears. Downward movement of the leg continues until the moving leg engages the support surface at which time the ladder will be vertically supported assuming the ladder islowered in a vertical position. Upon both legs 10 contacting the supporting surface, the weight of the ladder will tend to make one gear 45 rotate in one direction and and the other gear 45 rotate in the opposite direction and as the gears are coupled together gear rotation, due to weight applied by the ladder, is prevented.

Figure 8:
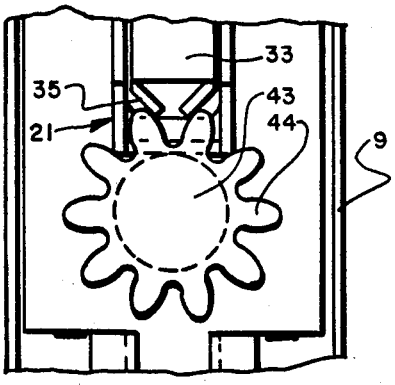
FIGS. 8 and 9 are fragmentary elevational views similar to FIG. 3 showing one of the stub shaft gears in two different locked positions with the locking device.
Figure 9:
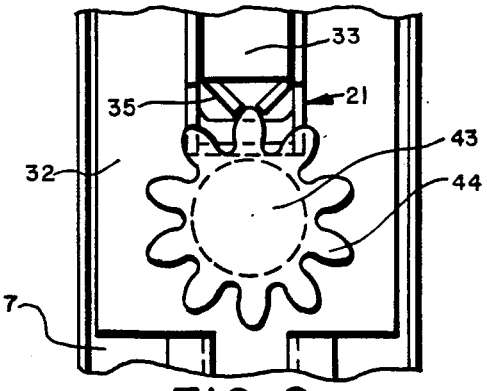

Gears 45 prior to the weight of the ladder being applied are in the position shown in FIG. 3 with lock teeth 35 being disengaged from gear teeth 44. Spring 38 biases plunger 21 downwardly until bottom surface 28 abuts the stub shaft which maintains gear lock teeth 35 out of locking engagement with gear 43 as shown in FIG. 3. Upon an operator placing the weight of the ladder on the legs, the weight will be sufficient to overcome the biasing force of springs 38 moving locking teeth 35 of gear lock 29 into engagement with one of the gear teeth 44 as shown in FIGS. 8 and 9 thereby locking the gears against rotation. The weight of the ladder and operator is placed directly upon gear lock plate 29 through gear lock element 33 and upop gears 43 and gear racks 15 thus locking legs 10 in the self leveling position. The locking teeth 35 of gear lock element 33 are shaped such that gear teeth 44 may engage the gear lock either by trapping a gear tooth between teeth 35 as shown in FIG. 9 or the locking teeth 35 may wedge themselves between two adjacent gear teeth 44 as shown in FIG. 9 to lock the gears against rotation. Either type of engagement is positive in its operation and slippage or malfunction practically impossible.

It will be understood that springs 38 will compress sufficiently under the weight of the upper ladder portion to engage the gear lock with the gears before the operator's weight is applied to any of the upper rungs. The operation is the same as above, e.g., the ladder is lowered to the supporting surface during the self-leveling phase and once the legs 10 are properly located to adapt themselves to the supporting surface and the ladder is vertical the operator releases the ladder such that the full weight of the upper ladder portion is supported by gears 43 engagement with gear lock teeth 35.

Should the occassion arise where the tips of the gear teeth 44 are engaged by the tips of one of the locked teeth 35 and upon the weight of the ladder the gear tooth of one gear 43 moved to the position wherein the gear tooth is between lock teeth 35 (FIG. 9) while the other teeth of the gear 43 moves in the opposite direction whereby the lock teeth 35 are wedged between two gear teeth (FIG. 8) a twisting torque will be applied to the means interconnecting the two gears and it is for this occasion that spring steel leaf 42 is employed. Should a twisting torque be imposed on stub shafts 39 and 40, the twist will occur in spring leaf 42 preventing subsequent damage to the stub shafts. The maximum out of alignment of stub shafts 39 and 40 as shown by FIGS. 8 and 9 will be nine degrees when gears 43 have ten teeth. This permissable angular unbalance will vary depending upon the particular number of teeth in gears 43 used for a particular ladder construction.

In accordance with one of the main features of the invention, the arrangement of stub shafts 39 and 40 with outer tubular member 45 wherein the stub shafts have an outer diameter generally complementary to the inner diameter of tubular member 45 and the attachment of member 45 to one of the shafts, eliminates the requirement of the additional components within the outer tubular member such as shown in my earlier Pat. No. 2,894,670 and eliminates the stationary mounting of an outer tubular member by brackets or other attachment devices further eliminating the number of components heretofore required to achieve the self-leveling affect. Furthermore, the incorporation of leveling legs 10 within the confines of main ladder support members 3 eliminates the additional weight required by attaching the leveling legs to the outside of the vertical rung supporting members thereby reducing even further the weight of the ladder and number of components required for achieving the self-leveling feature. Furthermore, the self-leveling mechanism is incorporated into the ladder at the factory and eliminates the operator or purchaser thereof from having to install the same on a ladder with the possibility of incorrect installation and possible malfunction thereof.

Accordingly, the invention provides an automatic self-leveling ladder for safe sure support regardless of terrain or floor conditions and that the locking of the legs 10 is positive and automatic and requires no attention on the part of the operator. The ladder furthermore is formed of rugged lightweight, preferably extruded aluminum and sheet metal components.

Accordingly, the improved self-leveling ladder is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved self-leveling ladder is constructed and used, the characteristics of the construction, and the advantageous, new and useful results obtained; the new and useful structures, devices, elements, arrangements, parts, and combinations, are set forth in the appended claims.

What is claimed is:

1. A self-leveling ladder construction including:

(a) a pair of spaced vertical rung supporting members;

(b) a leg axially slidably mounted within each of the rung supporting members at the bottom of each of said supporting members;

(c) a rack affixed to each of said legs;

(d) a rotatably mounted gear engaging each of said racks;

(e) drive means interconnecting the gears for simultaneous rotation in the same direction, said gears engaging the racks on opposite sides of the gears whereby movement of one of the legs in one direction produces an opposite movement of the other leg;

(f) gear lock means mounted on each of the rung supporting members adjacent each of the gear for engaging the gears to releaseably lock the gears in a selected position; and (g) said drive means including a stub shaft attached to each of the gears, a tubular telescoping member extending generally between the rung supporting members adapted to function as a lower rung and conected to one of the stub shafts for rotation with said shaft, and a leaf spring extending between and in engagement with the stub shafts within said tubular telescoping member, said stub shafts having outer diameters generally equal to the inner diameter of the telescoping member whereby said stub shafts support said telescoping member.

2. The self-leveling ladder defined in claim 1 in which the vertical rung supporting members are generally U-shaped channels open on one side; in which the legs are generally rectangular in cross section partially open along one side; and in which the legs are telescopically slidably mounted within the U-shaped channels of the rung supporting members.

3. The self-leveling ladder defined in claim 1 in which spring means biases the gears away from the gear lock means whereby placing the legs on a supporting surface permits said legs to automatically level themselves by application of the weight of the ladder on the legs sufficient to overcome the bias of the spring means lockingly engages the gear lock means with the gears.

4. The self-leveling ladder defined in claim 3 in which the gear lock means includes a gear lock fixed to each of the rung supporting members and a disengagement plunger slidably mounted with respect to the gear lock; and in which the spring means is a tension coil spring interposed between the gear lock and disengagement plunger.

5. The self-leveling ladder defined in claim 1 in which each of the gear lock means includes a gear lock fixed to the rung supporting member and a disengagement plunger slidably mounted with respect to the gear lock, said gear lock being engageable with the gear located vertically below said gear lock for locking the gears in a selected position.

6. The self-leveling ladder defined in claim 5 in which a tension coil spring is interposed between the gear lock and disengagement plunger biasing the plunger into engagement with the stub shaft to move the attached gear out of engagement with the gear lock.

7. The self-leveling ladder defined in claim 6 in which the gear lock includes a pair of spaced lock teeth; and in which said spaced lock teeth are engageable between spaced gear teeth of the gear or are adapted to trap one of the gear teeth between said spaced lock teeth to lock the gear in a selected position.

8. The self-leveling ladder defined in claim 5 in which each of the gear locks is formed with an elongated hole; and in which the stub shafts extend through the elongated holes of the gear locks permiting limited axial movement of the stub shaft when moving between locked and unlocked positions.

9. The self-leveling ladder defined in claim 7 in which each of the drive means gears have ten equally spaced gear teeth; in which the gears have a maximum movement of 9 degrees between engagement with the gear lock means to releaseably lock the gears in a selected position; and in which the leaf spring compensates for torsional forces exerted on the stub shafts upon misaligned engagement of the gear teeth with the gear lock means.

10. The self-leveling ladder defined in claim 1 in which the stub shaft extends through enlarged openings formed in the rung supporting members permitting axial movement of said stub shafts with respect to said members when the attached gears move between locked and unlocked positions.

11. The self-leveling ladder defined in claim 1 in which a tie rod is attached to and extends between the rung supporting member beneath the tubular telescoping member of the drive means.

12. The self-leveling ladder defined in claim 1 in which the stub shaft extends into the tubular telescoping member approximately one third of the length of said tubular member.

13. The self-leveling ladder defined in claim 1 in which the rack is formed with a plurality of vertically spaced holes extending at an inclined position with respect to each other; and in which said rack holes have one side at an inclined position.

* * * * *